US009918516B1

(12) United States Patent
Hall et al.

(10) Patent No.: US 9,918,516 B1
(45) Date of Patent: Mar. 20, 2018

(54) LACE 'N LOCK SHOE TYING SYSTEM

(71) Applicants: Wesley Hall, Pittsburgh, PA (US); Harley Marie Hobbs, Pittsburgh, PA (US); Chad Adam Lamfrom, Mars, PA (US); Hank F. Graygo, Erie, PA (US)

(72) Inventors: Wesley Hall, Pittsburgh, PA (US); Harley Marie Hobbs, Pittsburgh, PA (US); Chad Adam Lamfrom, Mars, PA (US); Hank F. Graygo, Erie, PA (US)

(73) Assignee: LNZ Products Inc., Erie, PA (US)

( * ) Notice: Subject to any disclaimer, the term of this patent is extended or adjusted under 35 U.S.C. 154(b) by 0 days.

(21) Appl. No.: 15/427,514

(22) Filed: Feb. 8, 2017

(51) Int. Cl.
*A43C 11/20* (2006.01)
*A43C 7/00* (2006.01)

(52) U.S. Cl.
CPC ..... *A43C 11/20* (2013.01); *A43C 7/00* (2013.01)

(58) Field of Classification Search
CPC ..... A43C 11/20; A43C 7/00
See application file for complete search history.

(56) References Cited

U.S. PATENT DOCUMENTS 3,197,155 A * 7/1965 Chow ..... A43C 7/00 242/378.3
5,157,813 A * 10/1992 Carroll ..... A43C 7/00 24/686
5,177,882 A * 1/1993 Berger ..... A43B 1/0072 36/50.1
5,333,398 A * 8/1994 Seo ..... A43C 7/00 24/712.9
5,477,593 A * 12/1995 Leick ..... A43C 7/00 24/136 A
6,694,643 B1 * 2/2004 Hsu ..... A43C 1/00 24/712.1
7,231,699 B2 * 6/2007 Borsoi ..... A43C 7/00 24/136 A
9,629,417 B2 * 4/2017 Cavanagh ..... A43C 11/20
9,681,705 B2 * 6/2017 Trudel ..... A43C 7/00
9,770,070 B2 * 9/2017 Cotterman ..... A43C 11/20
2005/0081339 A1 * 4/2005 Sakabayashi ..... A43C 7/00 24/128
2005/0098673 A1 * 5/2005 Huang ..... A43C 7/00 242/395
2006/0021204 A1 * 2/2006 Young ..... A43C 7/00 24/712.4
2007/0084956 A1 * 4/2007 Chen ..... A43C 7/00 242/388.6
2008/0196224 A1 * 8/2008 Hu ..... A43C 11/16 24/68 SK
2010/0251524 A1 * 10/2010 Chen ..... A43C 7/00 24/713.2
2011/0303782 A1 * 12/2011 Hu ..... A43C 11/165 242/388

(Continued)

*Primary Examiner* — Robert Sandy
*Assistant Examiner* — Louis A Mercado
(74) *Attorney, Agent, or Firm* — Richard K. Thomson

(57) ABSTRACT

A shoe tying system is provided enabling those who have difficulty reaching their shoe laces to tighten and loosen their laces by coiling and uncoiling to/from a rotatable drum using a specially configured key that can be positioned at the end of a cane, rod, or the like and used to manipulate the rotatable drum as desired.

3 Claims, 5 Drawing Sheets

(56) References Cited

U.S. PATENT DOCUMENTS

2014/0208550 A1* 7/2014 Neiley ..... A43C 7/00 24/712.1
2014/0290016 A1* 10/2014 Lovett ..... A43C 11/20 24/713.5
2014/0359981 A1* 12/2014 Cotterman ..... A43C 11/20 24/712.9
2015/0007422 A1* 1/2015 Cavanagh ..... A43C 11/165 24/68 SK
2015/0076272 A1* 3/2015 Trudel ..... A43C 7/00 242/381.4
2015/0230560 A1* 8/2015 Chen ..... A43C 11/20 24/68 SK
2015/0237962 A1* 8/2015 Soderberg ..... A43B 1/0081 24/71 SK
2015/0257489 A1* 9/2015 Trudel ..... A43C 11/20 24/68 SK
2015/0342304 A1* 12/2015 Modena ..... A43B 5/0401 36/115
2016/0058130 A1* 3/2016 Boney ..... A43C 1/06 24/712.6
2016/0066653 A1* 3/2016 Piva ..... A43C 11/165 248/332
2016/0120267 A1* 5/2016 Burns ..... A44B 11/065 24/68 C
2017/0027287 A1* 2/2017 Burns ..... A43C 11/165
2017/0105489 A1* 4/2017 Lovett ..... A43C 11/165
2017/0156448 A1* 6/2017 Modena ..... A43B 5/0401
2017/0202316 A1* 7/2017 Lovett ..... A43C 11/165
2017/0295888 A1* 10/2017 Chen ..... A43C 7/00
2017/0303644 A1* 10/2017 Cavanagh ..... A43C 11/165
2017/0311682 A1* 11/2017 Trudel ..... A43C 11/165
2017/0325548 A1* 11/2017 Ha ..... A43C 7/00
2017/0354207 A1* 12/2017 Signori ..... A43B 5/14

* cited by examiner

LACE 'N LOCK SHOE TYING SYSTEM

Applicants claim the benefit of provisional patent application Ser. No. 62/321,928 filed Jun. 18, 2016.

BACKGROUND AND SUMMARY OF THE INVENTION

The present invention is directed to a shoe tying system which allows shoes to be tied remotely.

More and more people are having trouble tying shoes because, due to physical restrictions, they are unable to reach the laces. It is among the objects of the present invention to allow shoe laces to be secured while the wearer is standing or sitting, without the need to actually manually engage the laces, once the system of the present invention has be put in place.

The present invention comprises a shoe tying system which permits remote tightening and loosening of shoe laces, the system comprising a) a base housing having a tongue securable beneath a portion of the laces of a shoe to be tightened; b) a rotatable column about which portions of those laces may be coiled to adjust a level of tension in those laces; c) a cap having a first configuration of slot in an upper surface; d) a key adapted to be fit on a remote end of an extension rod, the key having a second configuration complementary to the first configuration of the slot in the upper surface of the cap; whereby a wearer of the shoe to be tightened may remotely adjust a tension in the laces of the shoe by rotating said rotatable column in a first direction to increase the tension and in a second opposed direction to loosen the tension. The invention additionally comprises a geometrically shaped protrusion formed on a top surface of said rotatable column, a complementarily shaped recess formed on a nether surface of the cap, a spring biasing the recess away from said protrusion, whereby when the key collapses the spring bringing the recess into engagement with the protrusion, rotation of the key turns the cap and, with it, the rotatable column, winding and unwinding the shoe lace onto and from the rotatable column, tightening and loosening the shoe lace without requiring manual engagement thereof.

Additionally, the shoe tying system comprises at least a partial gear formed on an interior periphery of the cap, an external mating gear formed on an internal portion of the rotatable column, the partial gear and the external mating gear being adapted to maintain tension in the shoe lace when the key is disengaged from the cap.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 2A:
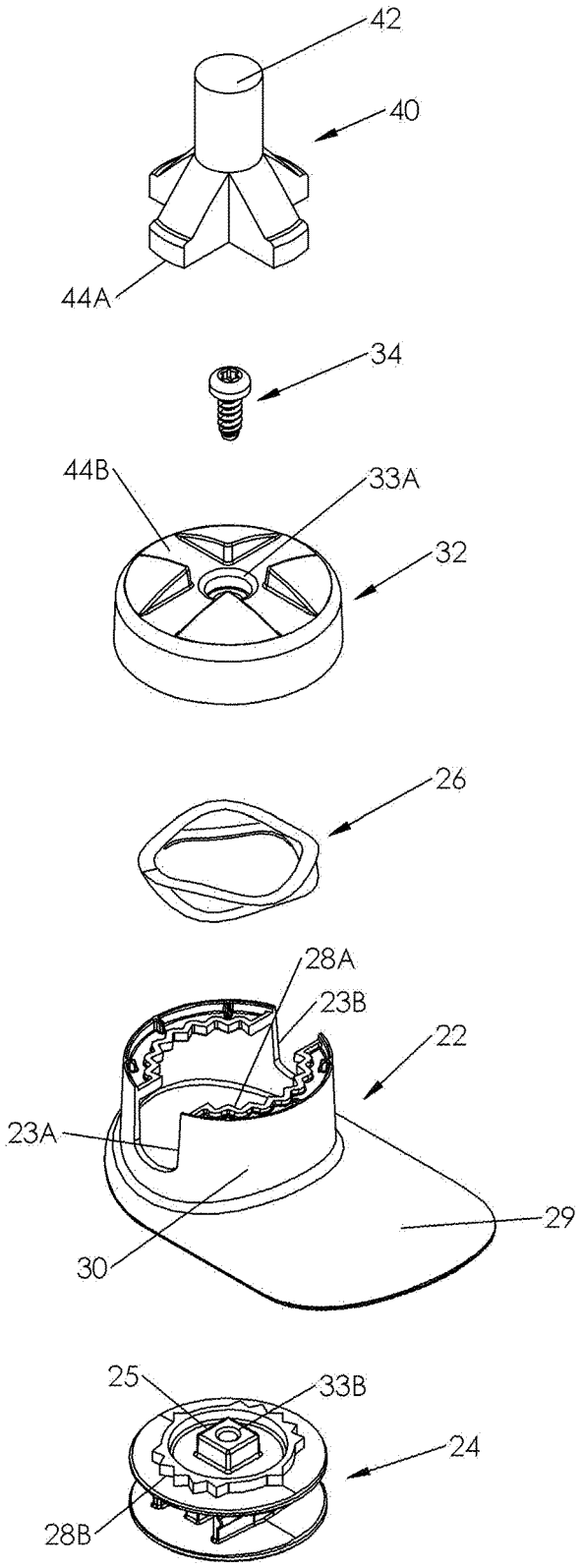
FIG. 2A is an exploded perspective view the first embodiment of the Lace 'n Lock shoe tying system shown in FIG. 1.

A first embodiment of the Lace 'n Lock shoe tying system of the present invention is depicted in FIG. 2A generally at 20. System 20 includes a base housing 22; lace lock 24; gear 28A on the inner periphery of housing 22; spring 26; attachment cap 32; screw 34; and key 40. The head of screw 34 is received in a recess 33A in cap 32 and is threaded into recess 33B in lace lock 24 holding the entire assembly 20 (less key 40) together. Ends 13, 15 of lace 11 (after being wound through the eyelets of a shoe) are extended in opposite directions through slots 27A and 27B which extend entirely through the width of lace lock 24 (see FIGS. 2B, 2C). Base housing 22 has opposing slots 23A and 23B allowing the lace ends 13, 15 to be inserted into slots 27A and 27B. Cruciform key 40 is received in complimentarily shaped slot 38 in cap 32 (FIG. 2A).

When screw 34 is tightened, gear 28A on the inner periphery of housing 22 is engaged by gear teeth 28B on the top of lace lock 24 preventing relative rotation between these two elements. By collapsing cap 32 against the pressure of spring 26 a small amount (say 1/16-1/8"), gear teeth 28B are disengaged from gear 28A allowing key 40 to rotate cap 32. Then, the square recess on the underside of cap 32 engages over post 25B and rotation of cap 32 causes ends 13, 15 of lace 11 of shoe 17 to spool around the outside of cylindrical tower 25 of lace lock 24. When the desired tension is achieved in lace 11, release of cap 34 allows spring 24 to re-engage the teeth of gear 28A with gear teeth 28B of lace lock 24 preventing the tension in the laces causing unwinding of lace 11. Reverse (counter-clockwise) rotation loosens the lace 11 permitting removal of shoe 17.

Figure 2D:
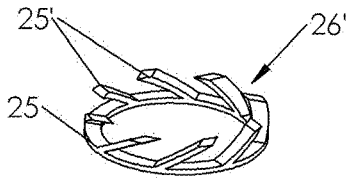
FIG. 2D is a side perspective view of an alternative form of spring.
Figure 2B:
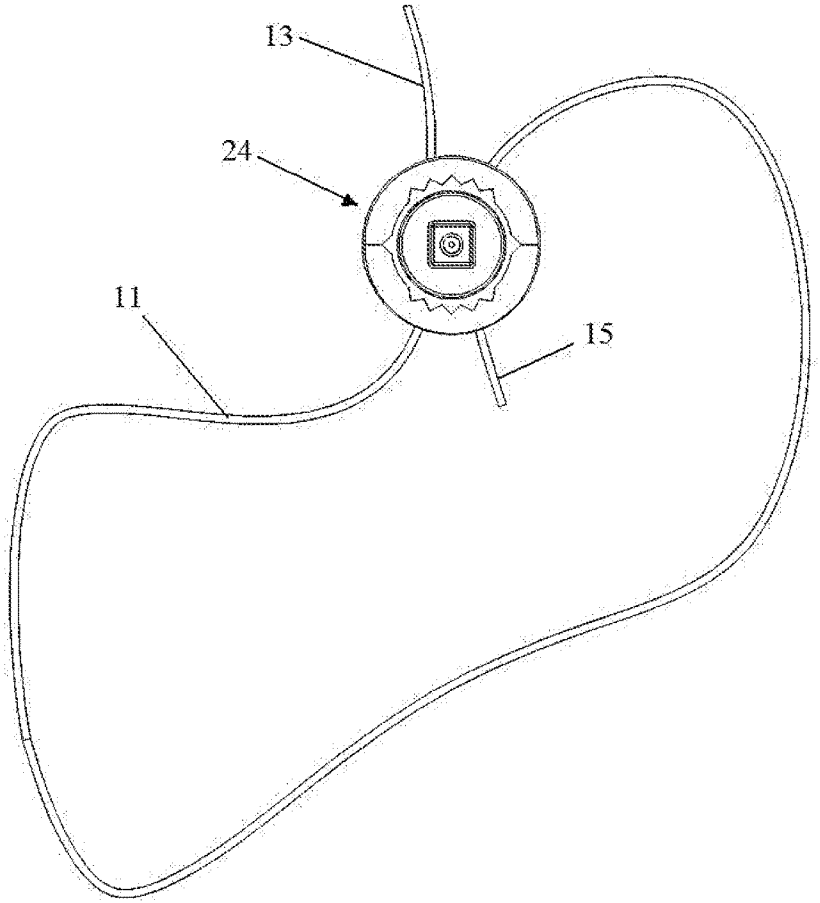
FIG. 2B is a top schematic view of the shoe lace interwoven through the Lace 'n Lock shoe tying system.
Figure 2C:
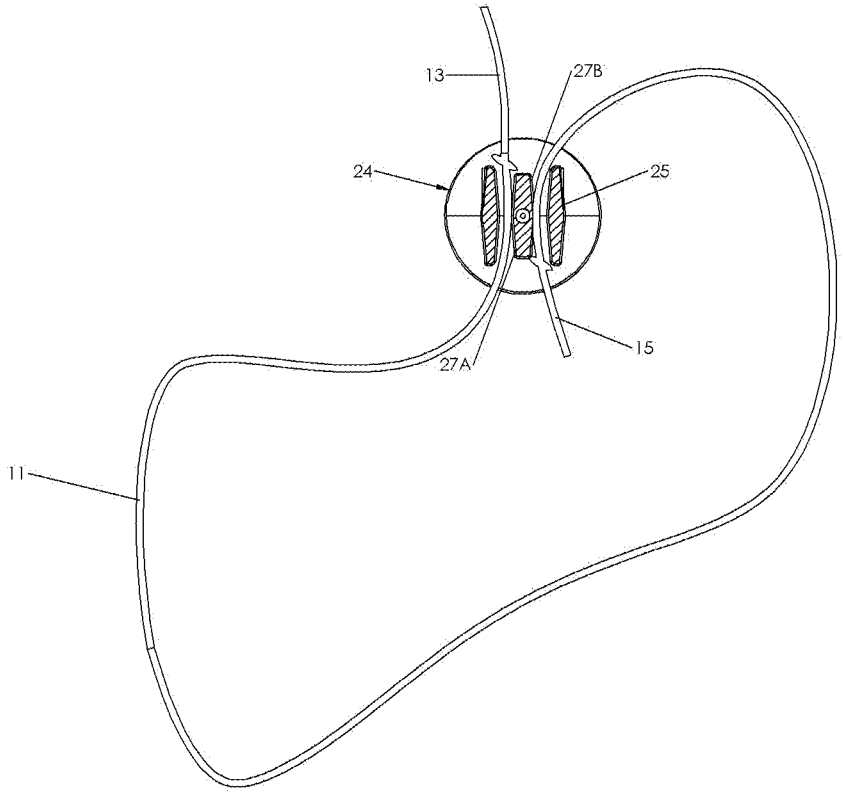
FIG. 2C is a cross-sectional view of the Lace 'n Lock shoe tying system as seen in FIG. 2B.

Spring 26, as shown in FIG. 2A, is a metal spring made of two wavy elements conjoined at a plurality of points. Alternatively, spring 26' can be made of plastic in which case a plurality of (e.g. 8) arcuate fingers 25' extend angularly from a ring 25 (FIG. 2D). Spring 26 normally biases a square recess formed on the underneath side of cap 32 away from square post 25B.

FIG. 2A depicts key 40 with a cruciform shape 44A configured to fit in slot 44B in cap 34. The proximate end of key 40 has a ½" opening 42 which can be received on the end of a walking cane or specifically configured tube of sufficient length (e.g., 2 ft) to allow engagement of key 40 in the slot 44B of cap 34 and rotated to tighten or loosen lace 11, as desired to eliminate the necessity to stoop to manipulate the lace 11. As an additional benefit, the key may serve as a non-slip stabilizer for those who regularly have need of a cane.

Figure 1:
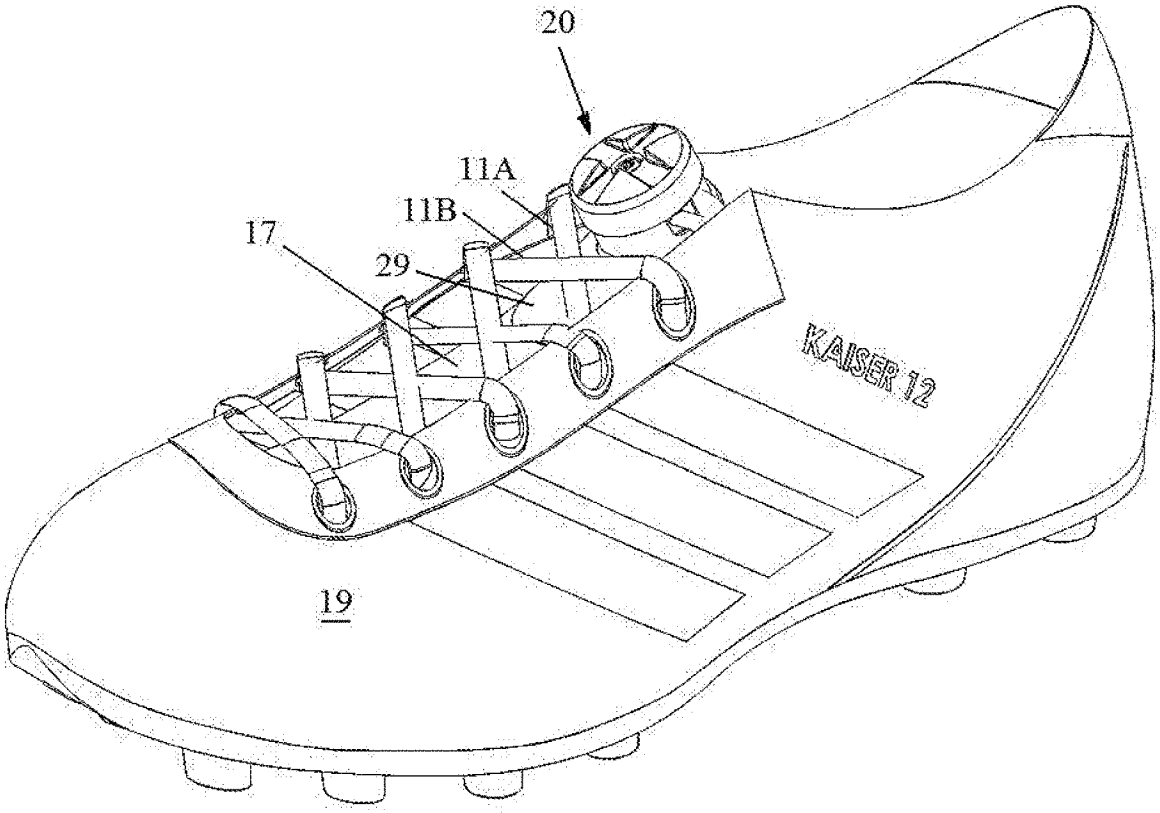
FIG. 1 is a perspective view of a first embodiment of the Lace 'n Lock shoe tying system of the present invention mounted upon an athletic shoe.
Figure 3:
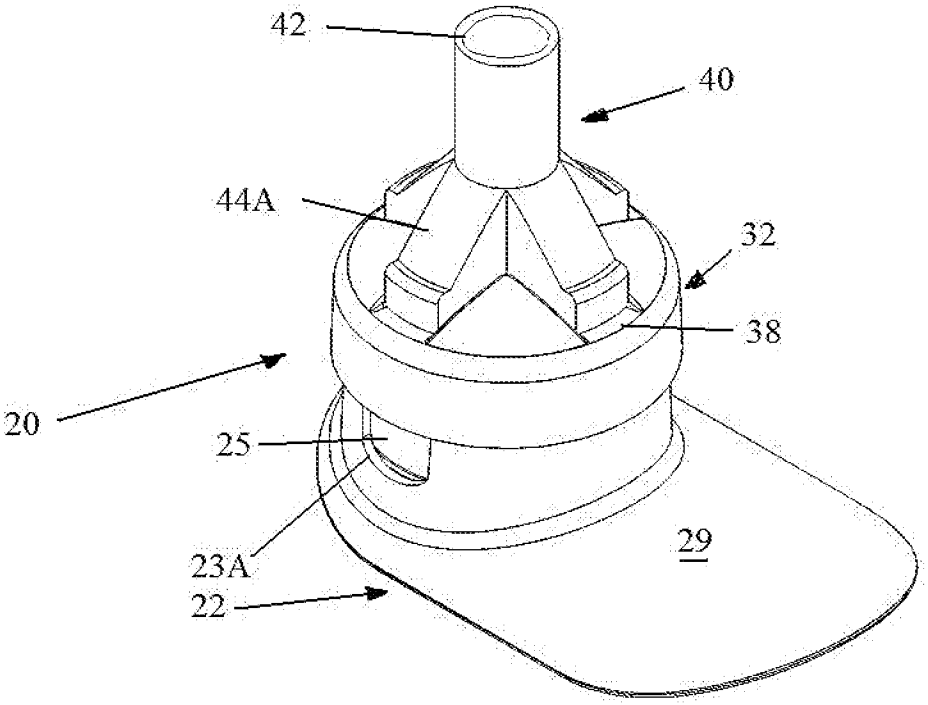
FIG. 3 is a front perspective view of the assembly of the first embodiment.

As shown in FIG. 1, the tongue 29 of base housing 22 is slipped under laces 11A and 11B and sits on the top of the tongue 17 of shoe 19. Although as depicted, shoe 19 has a conventional number of standard eyelets on each side, more preferably, shoe 19 is equipped with three specialty eyelets on each side which may be snapped over the standard eyelets to facilitate the insertion of the laces and the wearing of the shoe. By reducing the number of functioning eyelets and using specially formed reduced-friction eyelets, the operation of the Lace 'n Lock shoe tying system of the present invention is enhanced. Ends 13 and 15 can be inserted through slots 23A and 23B in base housing 22 and received in slots 27A and 27B in lace lock 24. Obviously, this assembly process could be performed prior to the user stepping into her/his shoe. Key 40 can be positioned on the end of a cane or specially configured rod (not shown) allowing the user to adjust the tension in her/his shoe remotely, i.e., without the need to directly, manually engage the laces 11A or 11B. Cruciform 44A of key 40 is inserted into slot 44B in cap 32 (FIG. 3) compressing spring 26 engaging gear teeth 28A and 28B (as well as square recess, not shown, with square post 25B) allowing the tightening and loosening of laces 11A and 11B by rotation of key 40 coiling/uncoiling laces 11A and 11B on/from around the tower 25 of lace lock 24.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

We claim:

1. A shoe tying system which permits remote tightening and loosening of shoe laces, said system comprising:

a) a base housing having a tongue securable beneath a portion of the laces of a shoe to be tightened;

b) a rotatable column about which portions of those laces may be coiled to adjust a level of tension in those laces;

c) a cap having a first configuration of slot in an upper surface;

d) a key adapted to be fit on a remote end of an extension rod, said key having a second configuration complementary to said first configuration of said slot in said upper surface of said cap;

whereby a wearer of the shoe to be tightened may remotely adjust a tension in the laces of the shoe by rotating said rotatable column in a first direction to increase the tension and in a second opposed direction to loosen the tension.

2. The shoe tying system of claim 1 further comprising a geometrically shaped protrusion formed on a top surface of said rotatable column, a complementarily shaped recess formed on a nether surface of said cap, a spring biasing said recess away from said protrusion, whereby when said key collapses said spring bringing said recess into engagement with said protrusion, rotation of said key turns said cap and, with it, said rotatable column, winding and unwinding the shoe lace onto and from said rotatable column, tightening and loosening the shoe lace without requiring manual engagement thereof.

3. The shoe tying system of claim 1 further comprising at least a partial gear formed on an interior periphery of said cap, an external mating gear formed on an internal portion of said rotatable column, said partial gear and said external mating gear being adapted to maintain tension in the shoe lace when said key is disengaged from said cap.

* * * * *